United States Patent [19]

Eichenberger et al.

[11] Patent Number: 4,970,851

[45] Date of Patent: Nov. 20, 1990

[54] COMBING MACHINE

[75] Inventors: Hansulrich Eichenberger, Winterthur; Walter Ackeret, Seuzach, both of Switzerland

[73] Assignee: Rieter Machine Works Ltd., Winterthur, Switzerland

[21] Appl. No.: 389,819

[22] Filed: Aug. 4, 1989

[30] Foreign Application Priority Data

Aug. 12, 1988 [CH] Switzerland ..... 3047/88

[51] Int. Cl.[5] ..... A01D 46/08; D01G 19/16

[52] U.S. Cl. ..... 56/34; 19/217; 19/225

[58] Field of Search ..... 56/34, 33, 127, 130, 56/35, 1, 28, 35, 2, DIG. 5; 460/129, 130; 19/115 R, 215, 217, 223, 225, 227, 229, 235

[56] References Cited

U.S. PATENT DOCUMENTS

| | | | |
|---|---|---|---|
| 3,387,612 | 6/1968 | Tillotson | 56/327.1 |
| 3,581,747 | 6/1971 | Schribner | 460/130 |
| 3,916,913 | 11/1975 | Looker et al. | 460/130 |
| 4,564,979 | 1/1986 | Ramasco | 19/115 R |
| 4,672,717 | 6/1987 | Shimomura | 19/225 |
| 4,928,357 | 5/1990 | Clement | 19/225 |

*Primary Examiner*—Ramon S. Britts
*Assistant Examiner*—Terry Lee Melius
*Attorney, Agent, or Firm*—Sandler, Greenblum & Bernstein

[57] ABSTRACT

The combing machine comprises a detaching roll and an oscillating nipper unit comrising bottom and top nippers. The predetermined spacing for the oscillating nipper unit with respect to the detaching roll is adjustable, such predetermined spacing being the spacing between the front edge of a bottom-nipper plate and the nip location at the detaching roll when the oscillating nipper unit is in its front end position. A top comb is held in top-comb holders. Each top-comb holder on a top-comb bed is pivotably adjustable about an axis substantially parallel to the detaching roll, the top-comb bed being secured at the bottom nipper. Subsequent to an adjustment of the predetermined spacing, the top-comb holders are reset such that pins of the top comb are again located at the same predetermined distance from the detaching roll. The position of the axis is selected such that, subsequent to adjusting the predetermined spacing and resetting the top-comb holders, the depth of penetration and the angle of penetration of the top-comb pins are practically the same as they were before. The depth and angle of penetration of the top-comb of the top-comb pins are measured relative to a tangential plane extending to the detaching roll from the lap delivery line at the bottom-nipper plate. Consequently, no separate elevational resetting of the top-comb pins is required subsequent to the adjustment of the predetermined spacing and the resetting of the top-comb holders.

4 Claims, 2 Drawing Sheets

COMBING MACHINE

BACKGROUND OF THE INVENTION

The present invention relates to a new and improved construction of combing machine comprising a detaching roll or roller and an oscillating nipper unit consisting of a bottom or lower nipper and a top or upper nipper, wherein the predetermined spacing for the oscillating nipper unit relative to the detaching roll is adjustable. This predetermined spacing is the spacing between the front edge of a bottom-nipper plate and the nip location at the detaching roll or roller, when the oscillating nipper unit is in a front end position. The combing machine also comprises a top comb which is secured at the bottom or lower nipper by means of top-comb holders which are pivotably adjustable relative to the bottom or lower nipper about an axis or pivot which is substantially parallel to the detaching roll or roller.

By adjusting the predetermined spacing, i.e. the front end position of the oscillating nipper unit, such front end position being the end position adjacent to the detaching roll or roller, the degree of combing-out can be altered and an adaptation to the staple of the fibers to be combed can be achieved. However, since the top-comb pins in the front end position of the oscillating nipper unit always have to be at a very small predetermined distance from the detaching roll or roller, a resetting of the top-comb holders relative to the bottom nipper is required subsequent to an adjustment of the predetermined spacing, in order to restore the aforesaid very small predetermined distance.

If the predetermined spacing is adjusted and the top-comb holders are reset in the aforesaid manner in a known combing machine of the type as described, the result would be a change in the depth of penetration of the top-comb pins into the lap, such lap moving from the bottom-nipper plate to the detaching roll or roller. Consequently, it would be also necessary to elevationally adjust the top-comb pins relative to their carrier plate which is retained in the top-comb holders, in order to obtain fairly constant or uniform penetration conditions and thus avoid the danger or risk of collision of the top-comb pins with the circular comb of the combing machine in the rear end position of the oscillating nipper unit, such rear end position being the end position remote from the detaching roll or roller. However, elevational adjustment of the top-comb pins represents a relatively complicated and time-consuming operation. Furthermore, elevational adjustment will not afford entirely uniform penetration conditions, because the adjustment of the predetermined spacing and the corresponding resetting of the top-comb holders in the known or prior-art combing machine will alter not only the depth of penetration of the top-comb pins, but also the angle of penetration, such angle of penetration being the angle between the top-comb pins and the lap running from the bottom-nipper plate to the detaching roll or roller.

SUMMARY OF THE INVENTION

Therefore, with the foregoing in mind, it is a primary object of the present invention to provide a new and improved construction of a combing machine which does not suffer from the aforementioned drawbacks and shortcomings of the prior art constructions.

It has been discovered that this object can be achieved in a very simple manner in that the axis or pivot, about which the top-comb holders are pivotably adjustable relative to the bottom or lower nipper, is positioned or located at the correct or appropriate position such that, subsequent to the adjustment of the predetermined spacing and the corresponding resetting of the top-comb holders, the depth of penetration as well as the angle of penetration remain substantially constant. Surprisingly, this is in fact possible, even when the geometry of motion of the bottom or lower nipper is relatively complicated, for example, when the bottom or lower nipper is conventionally pivoted at the rear thereof at a suitable crank and in front at a suitable front support, the crank and the front support each being pivotable about respective shafts mounted at the frame of the combing machine.

Now in order to implement these and still further objects of the present invention, which will become more readily apparent as the description proceeds, the combing machine of the present invention is manifested, among other things, by the features that the axis or pivot substantially parallel to the detaching roll or roller is positioned or located relative to the bottom or lower nipper such that in each and every adjustable predetermined spacing and at the predetermined distance of the top-comb pins to the detaching roll or roller, the depth of penetration and the angle of penetration relative to a tangential plane always are at least approximately constant, the tangential plane being defined as the plane to the detaching roll or roller from the lap delivery line at the bottom-nipper plate.

In the combing machine constructed according to the invention, elevational adjustment of the top-comb pins is no longer required subsequent to an adjustment of the predetermined spacing and a corresponding resetting of the top-comb holders for setting the predetermined distance of the top-comb pins to the detaching roll or roller. By virtue of the substantially constant depth of penetration and the substantially constant angle of penetration, the penetration conditions are still the same and the possible risk is avoided that the top-comb pins could collide with the circular comb subsequent to the adjustment of the predetermined spacing and the corresponding resetting of the top-comb holders.

The correct axis pivot location which is required for obtaining the advantage of not having to elevationally adjust the top-comb pins after spacing adjustment and top-comb holder resetting and about which axis or pivot the top-comb holders are pivotably adjustable, cannot be generally concretely defined because the location or position of the axis or pivot depends, among other things, on the geometry of motion of the bottom or lower nipper when the predetermined spacing is adjusted. However, the correct position or location of the axis or pivot can be readily determined in empirical manner for each individual case.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
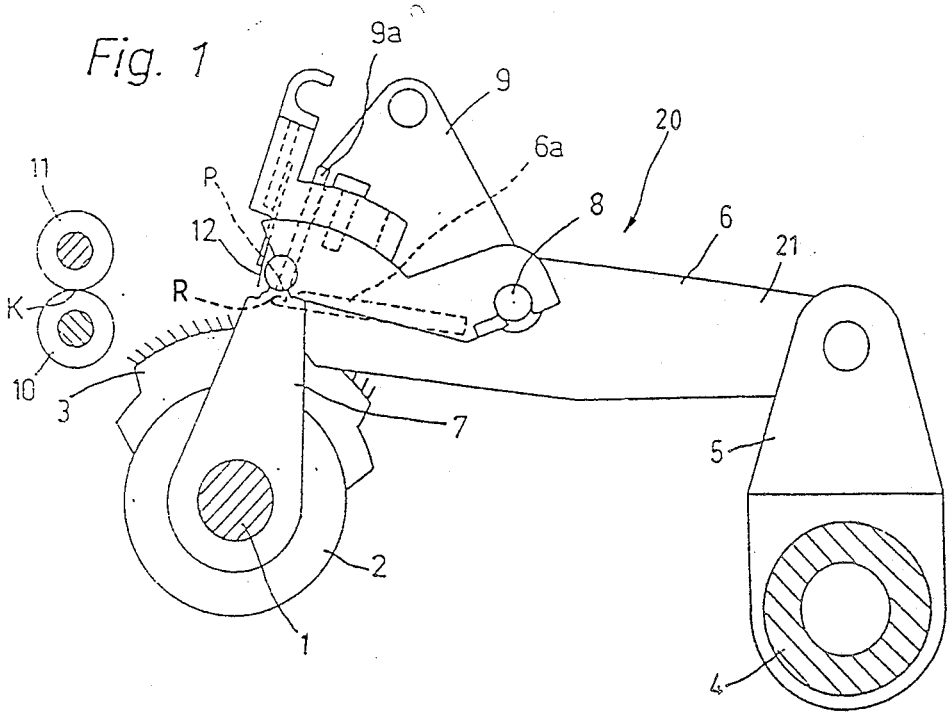
FIG. 1 is a schematic side view, partially in section, of parts of a combing head of a combing machine, the oscillating nipper unit being in a rear end position.

Describing now the drawings, it is to be understood that to simplify the showing thereof, only enough of the combing machine has been illustrated therein as is needed to enable one skilled in the art to readily understand the underlying principles and concepts of the present invention. Turning attention now specifically to FIGS. 1 and 2 of the drawings, a combing head 20 shown therein by way of example and not limitation will be seen to comprise a continuously rotating circular-comb shaft 1 which supports a circular-comb roll or roller 2 provided with a circular-comb segment 3, and a reciprocatingly rotating nipper shaft 4 which is substantially parallel to the circular-comb shaft 1 and supports a nipper crank 5. The rear end 21 of a bottom or lower nipper 6 is pivotably mounted at the nipper crank 5. The bottom or lower nipper 6 comprises a bottom-nipper plate 6a which is substantially parallel to the axis of the circular-comb roll or roller 2. The front end 22 of the bottom or lower nipper 6 is pivotably mounted at a front support 7 which is pivotable about the axis of the continuously rotating circular-comb shaft 1. A top or upper nipper 9 is pivotably mounted at the bottom or lower nipper 6 for pivotal movement about an axle or pivot 8. This top or upper nipper 9 comprises a top-nipper plate 9a which is substantially parallel to the axis of the circular-comb roll or roller 2.

In the rear end position of the oscillating nipper unit 6, 9 shown in FIG. 1, the oscillating nipper unit is closed. A fiber tuft not specifically shown in the drawing is clamped between a front edge R of the bottom-nipper plate 6a and a front edge P of the top-nipper plate 9a and is combed out by the circular-comb segment 3 at the rotating circular-comb roll or roller 2.

Figure 2:
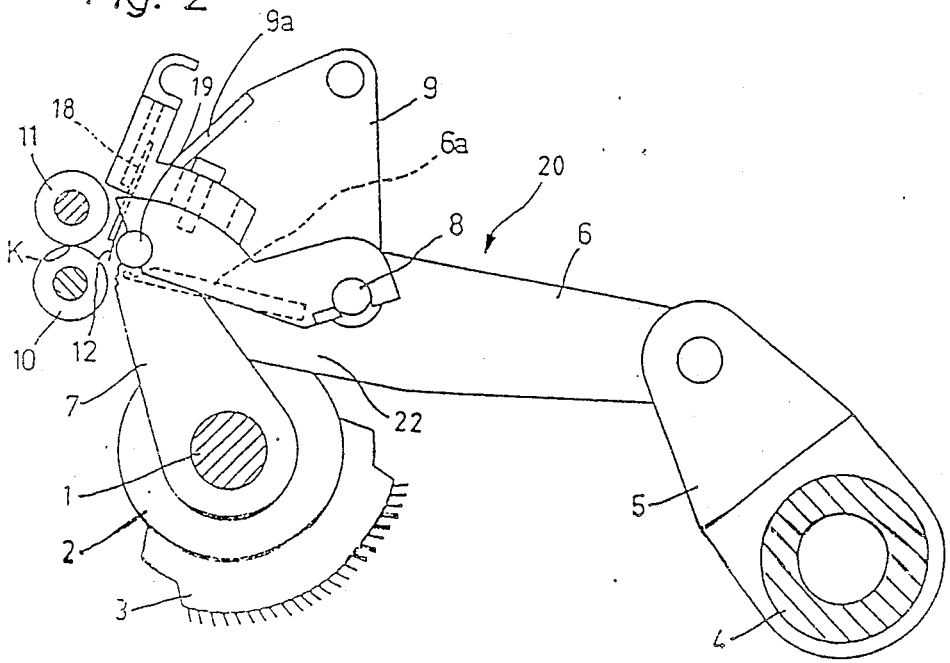
FIG. 2 shows the same schematic side view of the parts of the combing head in FIG. 1, the oscillating nipper unit being in a front end position.

The oscillating nipper unit 6, 9 is then moved into the front end position depicted in FIG. 2, in which front end position the oscillating nipper unit 6, 9 is open and the combed-out tuft is united with the previously combed-out lap at a detaching roll or roller 10. This detaching roll or roller 10 cooperates with a detaching press or pressing roll or roller 11 at a nip location K and draws the lap into the latter through a top comb 18 comprising a row of top-comb pins 12.

Figure 3:
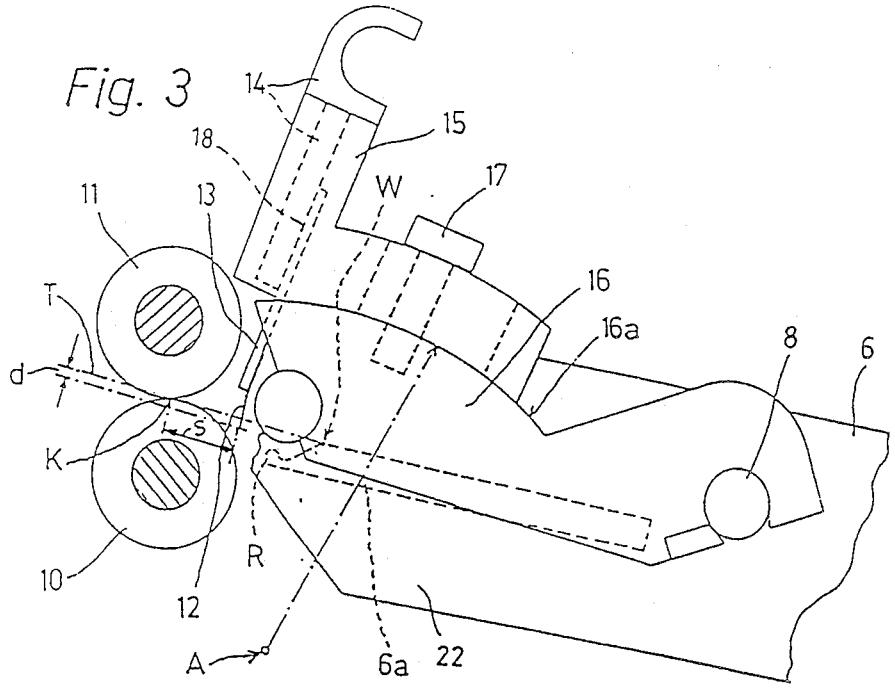
FIG. 3 schematically shows on an enlarged scale and in partially sectional side view a detail of the parts of the combing head in FIG. 2.
Figure 4:
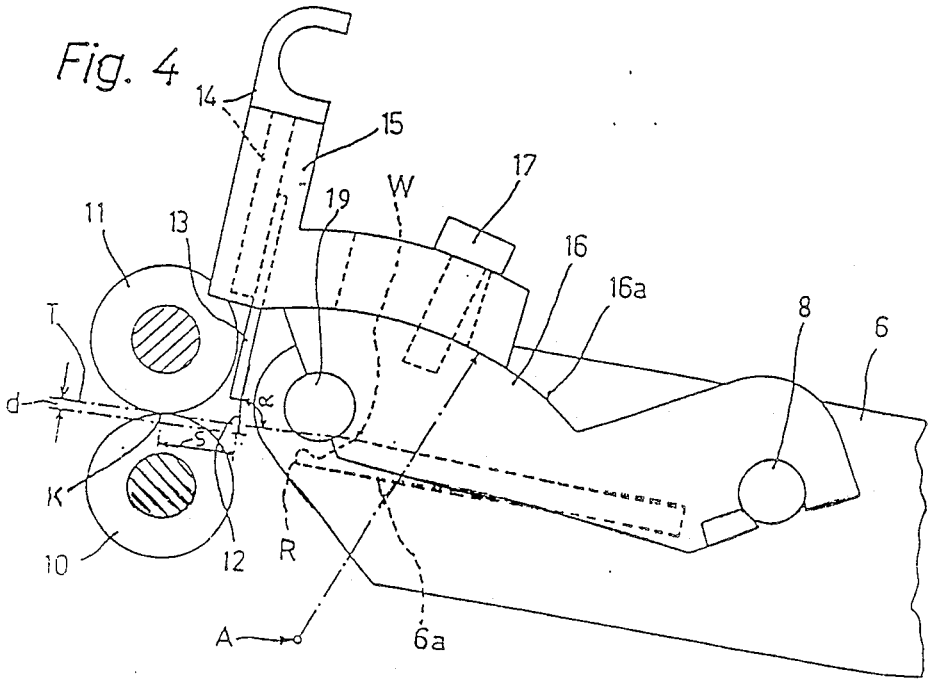
FIG. 4 shows the same detail depicted in FIG. 3, the combing head having a larger predetermined spacing than in FIG. 3.

The top-comb pins 12 are arranged at a strip 13 depicted in FIGS. 3 and 4 and mounted at a bearer or supporting plate 14. This bearer or supporting plate 14 is held or retained at its two ends in respective top-comb holders 15.

It is to be observed that since essentially similar structure is provided at the opposite side of the bearer or supporting plate 14 from that shown in the drawings, it will suffice for reasons of simplicity to consider both sides of the combing head 20 only in conjunction with the visible side depicted in the drawings.

The top-comb holders 15 are adjustable at respective top-comb beds 16 along arcuate guideways 16a defining a circular path about an axis or pivot A. The top-comb beds 16 are secured at the bottom or lower nipper 6, for example, by being clamped at the axle or pivot 8 of the top or upper nipper 9 and at the axle or pivot 19 of the front support 7. Therefore, the top-comb holders 15 and with them the top comb 18 including the strip 13 with the top-comb pins 12 are pivotably adjustable about the axis or pivot A with respect to the bottom or lower nipper 6. In each set position the top-comb holders 15 can be fixed or secured relative to the bottom or lower nipper 6 by respective clamping screws 17 or equivalent structure, each of which is screwed into the respective top-comb bed 16 and extends through an elongated hole in the respective top-comb holder 15.

The axis or pivot A, which is substantially parallel to the detaching roll or roller 10 and, therefore, also substantially parallel to the circular-comb roll or roller 2 as well as to the front edge R of the bottom-nipper plate 6a and the front edge P of the top-nipper plate 9a, is positioned or located relative to the bottom or lower nipper 6 such that when the predetermined spacing is adjusted, the depth d of penetration and the angle $\alpha$ of penetration of the top-comb pin 12 practically remain constant. This will be discussed in greater detail hereinafter.

The predetermined spacing is the spacing between the front edge R of the bottom-nipper plate 6a and the nip location K at the detaching roll or roller 10, when the oscillating nipper unit 6, 9 is in its front end position. The predetermined spacing is adjustable by varying the front end position of the oscillating nipper unit 6, 9, for example, by varying the position of the nipper crank 5 at the nipper shaft 4.

When the predetermined spacing is adjusted, for example, from the relatively small spacing in FIG. 3 to the larger spacing in FIG. 4, the top-comb holders 15 must be reset along the guideways 6a of the top-comb beds 16 by pivoting about the axis or pivot A, in order that the top-comb pins 12 are then again at the same relatively small predetermined distance S from the detaching roll or roller 10.

The depth d of penetration of the top-comb pins 12 in the front end position of the oscillating nipper unit 6, 9 is measured relative to a tangential plane T extending from a lap delivery line W at the bottom-nipper plate 6a to the detaching roll or roller 10, instead of measuring relative to the lap which during operation runs from the lap delivery line W to the detaching roll or roller 10. It is thus conceivable that by virtue of the selected position or location of the axis or pivot A, the depth d of penetration of the top-comb pins 12 is practically the same prior to and subsequent to adjustment of the predetermined spacing and to corresponding resetting of the top-comb holders 15. The sam applies to the angle $\alpha$ of penetration which the top-comb pins 12 define with the tangential plane T. Irrespective of the set predetermined spacing, the angle $\alpha$ of penetration always is practically of the same magnitude when the top-comb holders 15 are reset such that the top-comb pins 12 are substantially at the same predetermined distance S from the detaching roll or roller 10, each such predetermined spacing, predetermined distance S, penetration depth d and penetration angle $\alpha$ pertaining to the front end portion of the oscillating nipper unit 6, 9. Therefore, the penetration conditions always are substantially the same irrespective of the set predetermined spacing, without having to elevationally adjust the top-comb pins 12 by moving the strip 13 relative to the bearer or supporting plate 14.

While there are shown and described present preferred embodiments of the invention, it is to be distinctly understood that the invention is not limited thereto, but may be otherwise variously embodied and practiced within the scope of the following claims. Accordingly,

What We claim is:

1. A combing machine, comprising:

a detaching roll;

a detaching pressure roll;

said detaching roll and said detaching pressure roll defining therebetween a nip line at said detaching roll;

an oscillating nipper unit having a front end position and a rear end position;

said oscillating nipper unit comprising a bottom nipper and a top nipper;

said bottom nipper comprising a bottom-nipper plate;

said bottom-nipper plate having a front edge and a lap delivery line;

said detaching roll and said detaching pressure roll being arranged in cooperating relationship with said oscillating nipper unit such that, in said front end position of said oscillating nipper unit, said nip line at said detaching roll;

said predetermined spacing being adjustable;

a top comb comprising top-comb pins;

top-comb holders;

said top comb being secured at said bottom nipper by said top-comb holders;

said top-comb pins being at a predetermined distance from said detaching roll;

said lap delivery line and said nip line at said detaching roll defining a tangential plane;

said top-comb pins having a predetermined depth of penetration and a predetermined angle of penetration of said top comb pins with respect to said tangential plane;

said top-comb holders being pivotably adjustable relative to said bottom nipper about an axis which is substantially parallel to said detaching roll; and said axis being located relative to said bottom nipper such that, in said front end position of said oscillating nipper unit and at each and every adjustable predetermined spacing and at said predetermined distance of said top-comb pins to said nip line at said detaching roll, said predetermined depth of penetration and said predetermined angle of penetration with respect to said tangential plane are always at least approximately constant.

2. A combing machine, comprising:

a detaching roll;

a detaching pressure roll;

said detaching roll and said detaching pressure roll defining therebetween a nip line at said detaching roll;

an oscillating nipper unit having a front end position and a rear end position;

said oscillating nipper unit comprising a bottom nipper and a top nipper;

said bottom nipper comprising a bottom-nipper plate;

said bottom-nipper plate having a front edge and a lap delivery line;

said detaching roll and said detaching pressure roll being arranged in cooperating relationship with said oscillating nipper unit such that, in said front end position of said oscillating nipper unit, said nip line at said detaching roll defines a predetermined spacing with respect to said front edge of said bottom-nipper plate;

said predetermined spacing being adjustable;

a top comb comprising top-comb pins;

top-comb holders;

said top comb being secured at said bottom nipper by said top-comb holders;

said top-comb pins being at a predetermined distance from said detaching roll;

said lap delivery line and said nip line at said detaching roll defining a tangential plane;

said top-comb pins having a predetermined depth of penetration and a predetermined angle of penetration of said top comb pins with respect to said tangential plane;

said top-comb holders being pivotably adjustable relative to said bottom nipper about an axis which is substantially parallel to said detaching roll;

said axis being located relative to said bottom nipper such that, in said front end position of said oscillating nipper unit and at each and every adjustable predetermined spacing and at said predetermined distance of said top-comb pins to said nip line at said detaching roll, said predetermined depth of penetration and said predetermined angle of penetration with respect to said tangential plane are always at least approximately constant;

top-comb beds provided for said top-comb holders;

said top-comb beds being secured at said bottom nipper;

said top-comb beds each having an arcuate guideway for said top-comb holders;

said arcuate guideway defining a circular path about said axis; and said top-comb holders being adjustable along respective said arcuate guideways.

3. The combing machine as defined in claim 2, further including:

a rear fixedly mounted nipper shaft;

a rear nipper crank pivotably mounted at said rear fixedly mounted nipper shaft;

said bottom nipper being pivotably coupled to said rear nipper crank;

a forward fixedly mounted circular-comb shaft;

a front support pivotably mounted at said forward fixedly mounted circular-comb shaft; and said bottom nipper being pivotably coupled to said front support.

4. A combing machine, comprising:

a detaching roll;

a detaching pressure roll;

said detaching roll and said detaching pressure roll defining therebetween a nip line at said detaching roll;

a displaceable nipper unit having a front end position and a rear end position;

said displaceable nipper unit comprising a bottom nipper and a top nipper;

said bottom nipper comprising a bottom-nipper plate;

said bottom-nipper plate having a front edge and a lap delivery line;

said detaching roll and said detaching pressure roll being arranged in cooperating relationship with said displaceable nipper unit such that, in said front end position of said displaceable nipper unit, said nip line at said detaching roll defines a predetermined spacing with respect to said front edge of said bottom nipper plate;

top comb means comprising top-comb pins;

top-comb holder means;

said top comb means being secured at said bottom nipper by said top-comb holder means;

said top-comb pins being at a predetermined distance from said detaching roll;

said lap delivery line and said nip line at said detaching roll defining a tangential plane;

said top-comb pins having a predetermined depth of penetration and a predetermined angle of penetration of said top comb pins with respect to said tangential plane;

said top-comb holder means being pivotably adjustable relative to said bottom nipper about an axis which is substantially parallel to said detaching roll; and said axis being located relative to said bottom nipper such that, in said front end position of said oscillating nipper unit and at each and every adjustable predetermined spacing and at said predetermined distance of said top-comb pins to said nip line at said detaching roll, said predetermined depth of penetration and said predetermined angle of penetration with respect to said tangential plane remain at least approximately constant.

* * * * *